US005737863A

United States Patent [19]

Rainey, III

[11] Patent Number: 5,737,863

[45] Date of Patent: Apr. 14, 1998

[54] MUZZLE LOADING FIREARM PROJECTILE

[76] Inventor: William F. Rainey, III, Rt. 1, Box 166-B-81, Galveston, Tex. 77554

[21] Appl. No.: 784,085

[22] Filed: Jan. 15, 1997

Related U.S. Application Data

[60] Division of Ser. No. 432,799, May 2, 1995, Pat. No. 5,623,779, which is a continuation-in-part of Ser. No. 154,280, Nov. 18, 1993, abandoned.

[51] Int. Cl.[6] ..... F41A 21/18

[52] U.S. Cl. ..... 42/51; 42/78

[58] Field of Search ..... 102/501; 42/51, 42/78; 89/1.3, 14.6

[56] References Cited

U.S. PATENT DOCUMENTS

| | | | |
|---|---|---|---|
| H167 | 12/1986 | Forster et al. | 102/524 |
| 3,483,794 | 12/1969 | Packard | 89/14.6 |
| 3,815,503 | 6/1974 | Infantino | 102/501 |
| 4,353,181 | 10/1982 | Pedgonay | 42/78 |
| 5,435,089 | 7/1995 | Rodney, Jr. | 42/51 |

FOREIGN PATENT DOCUMENTS

| | | | |
|---|---|---|---|
| 6940 | 7/1901 | United Kingdom | 102/501 |

*Primary Examiner*—Stephen M. Johnson

*Attorney, Agent, or Firm*—Vaden, Eickenroht & Thompson, L.L.P.

[57] ABSTRACT

A muzzle-loading firearm designed to utilize an ignition device carrier and to discharge projectiles having pre-cut rifling. The ignition device carrier serves to facilitate easy installation and removal of the primer or percussion cap required to discharge the firearm in addition to protecting both the primer from inclement weather and the shooter from powder detonation. The carrier also provides a means for positive mechanical extraction of the ignition device from the weapon. Projectiles for the firearm have the rifling grooves cut into them by forcing the bullets through an engraving die fashioned from a portion of the rifle barrel or from a separate barrel of slightly different dimensions than the barrel of the weapon which will fire the projectiles.

3 Claims, 7 Drawing Sheets

MUZZLE LOADING FIREARM PROJECTILE

This application is a division of application Ser. No. 08/432,799, filed May 2, 1995, now U.S. Pat. No. 5,623,779 which is a continuation-in-part of application Ser. No. 08/154,280, filed Nov. 18, 1993 now abandoned.

BACKGROUND

1. Field of Invention

This invention relates to a utility improvement in muzzle-loading firearms, specifically to the elimination of parts, improvement of accuracy, ease of loading, and an improved means of handling percussion ignition devices.

2. Description of Prior Art

Typically, a muzzle-loading firearm comprises a barrel which is substantially closed at one end and is loaded by placement of the powder and the desired projectile(s) into the barrel from the open or muzzle end. The ignition source is typically a small percussion device placed so as when struck with the hammer of the firing mechanism, the resulting pyrotechnic flame is transmitted through a rather small opening into the closed end of the barrel (breech end) where it ignites the powder, thus causing the firearm to discharge.

The ignition device may also be of the older variety comprised of a flint or other material attached to a movable hammer which when caused to rapidly contact a striker plate, a spark is generated. This spark ignites a small powder charge in the frizzen pan. The burning powder then ignites the powder in the breech through a small hole in the closed end of the barrel, thus causing the firearm to discharge. This type of ignition system is commonly referred to as a "flintlock".

Traditional firearms may have barrels of two types. The barrel may be of the smoothbore type as is typical of shotguns and traditional muskets. The firearms barrel may also be rifled, meaning the barrel is formed so as to have a spiral or twisted, internally grooved configuration. In some cases the actual bore may be polygon shaped and made to have the same internal spiral or twisted internal configuration. This spiral internal configuration is commonly referred to as rifling. The twist of the grooved or polygon shaped bore imparts a spinning motion to the projectile as it is expelled from the barrel by the detonation of the powder charge. The spinning motion of the projectile helps to stabilize the projectile in flight once it has cleared the muzzle of the firearm.

Traditional muzzle-loading rifles are loaded with a solid lead round ball with a cloth or paper patch serving as both a seal between the ball and bore and as a means to grip the rifling of the bore. Solid lead bullets may also be fired from muzzle-loaders. In this case, the bullet is forced into the muzzle of the rifle without the cloth patch as is used with the round ball. The rifling is engraved on the lead bullet as it is forced into the nuzzle of the firearm. In both cases the rifling of the barrel tends to spin the projectile as it is fired. The faster the projectile can be spun, the greater the stabilizing effect, and therefore the accuracy potential is increased. The reliance upon the cloth patch or relatively soft pure lead to grip the rifling of the barrel in order to spin the projectile limits the rate of twist which may be effectively used in the rifle barrel. The shallow rifling (and resulting weak rifling/bullet grip strength), which may be engraved on a lead bullet when forced into the muzzle by hand, limits the rifling twist rate that can be used on rifles intended to fire lead bullets with the rifling engraved upon loading. Twist rates are typically one turn in forty-eight inches or more. Twist rates faster than this tend to produce rather inconsistent results as the cloth patches or pure lead projectiles do not provide sufficient gripping action to allow a consistent stabilizing spin to be imparted to the projectiles. That is, the mechanical gripping action between the lead projectiles and the rifling is lacking in sufficient strength to prevent slippage at twist rates faster than one turn in forty-eight inches.

One method of improving the bullet's ability to grip the rifling of the barrel is the use of a plastic sabot, which acts as a carrier for the bullet. This sabot has been a minor improvement, but also is found lacking. The bullet used with a sabot must be of smaller diameter than the rifle bore and is thus lighter than the normal bullet with correspondingly less kinetic energy when fired. The kinetic energy of the bullet is of significant importance to hunters as well as shooters participating in metallic silhouette competition. The sabot, while allowing the use of modern jacketed bullets, offers limited, if any, improvement in the rifling/bullet gripping concern.

Traditional means of muzzle-loading firearm ignition leave much desired in regard to reliability, ease of use, consistency, and susceptibility to inclement weather conditions. Flintlock or matchlock weapons are essentially unusable in rainy weather as the powder in the pan cannot be kept dry. The handling of flintlock weapons is also of great importance as the priming powder carried in the pan may be lost if the firearm is not handled in the proper orientation.

The advent of the percussion ignition system alleviated some of the problems associated with the flintlock; however, the percussion caps are small, making them difficult to handle, particularly in times of limited light and cold weather. These caps are also very susceptible to spoilage by inclement weather and may fall from the firing mechanism unbeknownst to the user. Even under the best of conditions, the flintlock or percussion cap may fail to ignite the powder due to an inadequate spark or an obstruction in the flash hole leading to the powder chamber. All of these conditions lead to a rather unreliable ignition system for use as a firing mechanism.

Further advances in the art such as U.S. Pat. Nos. 3,780,464 Anderson December 1993, 4,114,303 Vaughn September 1978, 4,222,191 Lee et al. September 1980, 4,227,330 Chapin October 1980, 4,232,468 Chapin November 1980, 4,283,874 Vaughn August 1981, 4,437,249 Brown et al. March 1984, 4,912,868 Thompson April 1990, and 5,010,677 Verney Carron April 1991 in one fashion or another utilize a metallic cartridge or shotgun type of ignition primer. Without exception, all of these designs utilize a loose primer which must be placed in position by the shooter's fingers or a tool fashioned for the task. Again, all of these designs present varying degrees of difficulty in removing the fired primer and the insertion of another for repeated firing of the weapon.

U.S. Pat. Nos. 3,780,464 Anderson December 1973, and 4,283,874 Vaughn August 1981 have a cap which is screwed over the primer. This is a time consuming and delicate task, as is the placement and removal of the primer. This should be considered a safety hazard in that the shooter, due to the time and difficulty involved, would not be inclined to remove the primer to eliminate the possibility of accidental discharge of the weapon while climbing fences or into a blind or elevated stand. This insertion and removal of the primer from the weapon is made even more difficult in cold or wet conditions when the shooter may be wearing gloves or mittens. In the early morning or late evening under poor light conditions, this task would also be extremely difficult.

U.S. Pat. No. 4,114,303 Vaughn September 1978 utilizes a shotgun type primer which is exposed to the elements and is susceptible to loss. This design also provides no means for extraction of the primer either before or after firing.

U.S. Pat. No. 4,222,191 Lee et al. September 1980, 4,227,330 Vaughn October 1980, 4,232,468 Chapin November 1980 also utilize a shotgun type primer and do provide protection from the elements. However, no provisions are made to facilitate easy insertion or removal of the primer.

U.S. Pat. No. 4,437,249 Brown et el. March 1984 and 4,912,868 Thompson April 1990 provide means for partial extraction of the primer, but both must be removed with the aid of a fingernail or knife blade. The insertion of the primer as taught in patent '868 is difficult in that it must be placed in the breech plug through the shell ejection port of the shotgun. This task is difficult under ideal conditions, and practically impossible under adverse conditions of poor light and cold weather.

U.S. Pat. No. 3,757,447 Rowe September 1973, 4,700,499 Knight October 1987, and 5,133,143 Knight July 1992 all utilize the traditional percussion cap. All three designs have the cap placed on a nipple which is accessible only through a small opening. In these designs, installation and removal of the cap is a difficult and tedious task due to the restricted access to the nipple.

U.S. Pat. No. 5,010,677 Verney Carron April 1991 utilizes a shotgun type primer and a spring defined as "likely to extract the primer". This design, while partially expelling the primer, does not positively remove it nor does it facilitate easy installation.

None of the referenced patents disclose an ignition system conducive to quick and easy installation and removal of the primer or percussion cap under even the best of conditions.

Muzzle-loading firearms are typically cleaned by removing the percussion cap nipple, placing the breech or closed end of the barrel in a container of hot soapy water and pumping this hot water through the bore using a cleaning patch on the end of a cleaning rod. This cleaning technique precludes the use of short-eye-relief telescopic sights on muzzle-loaders, as the sight would have to be immersed in the hot water during the cleaning of the weapon.

No prior art concerning the use of pre-engraved bullets in muzzle-loading firearms has been discovered.

OBJECTS AND ADVANTAGES

Accordingly, several objects and advantages of my muzzle-loading firearm are:

(a) to provide a technique of producing modern gilding metal jacketed or pure lead bullets with precut rifling which may be fired from barrels with faster twist rates (one turn in sixteen inches or less) than the heretofore standard maximum twist rates of one turn in forty-eight inches, thus enhancing the accuracy potential of the rifle;

(b) to provide a bullet easily loaded into the barrel of a muzzle-loading firearm;

(c) to provide a muzzle-loading firearm without a fragile percussion cap nipple;

(d) to provide an easily cleaned muzzle-loading firearm which can be fitted with a standard short-eye-relief telescopic sight;

(e) to provide an ignition system which is well protected from the elements with a primer that is easily installed and removed;

(f) to provide a muzzle-loading firearm with a positively extracted primer, thus providing an easier-to-reload firearm;

(g) to provide a muzzle-loading firearm with improved safety potential due to the ease of installation and removal of the primer;

(h) to provide a muzzle-loading firearm adaptable to any standard rifle, shotgun or pistol type action, thus allowing the utilization of proven mechanical safety systems from those existing designs; and (i) to provide a muzzle-loading firearm adaptable to any standard rifle, shotgun or pistol type action, thus allowing the utilization of proven positive extraction methods.

Further objects and advantages are to provide a muzzle-loading firearm with a reduced number of delicate parts and thereby one being easier or more economical to manufacture. Still further objects and advantages will become apparent to persons skilled in the art of firearms design and manufacture from a consideration of the ensuing description and drawings of applicant's muzzle-loading firearm.

DRAWING FIGURES

Figure 13:
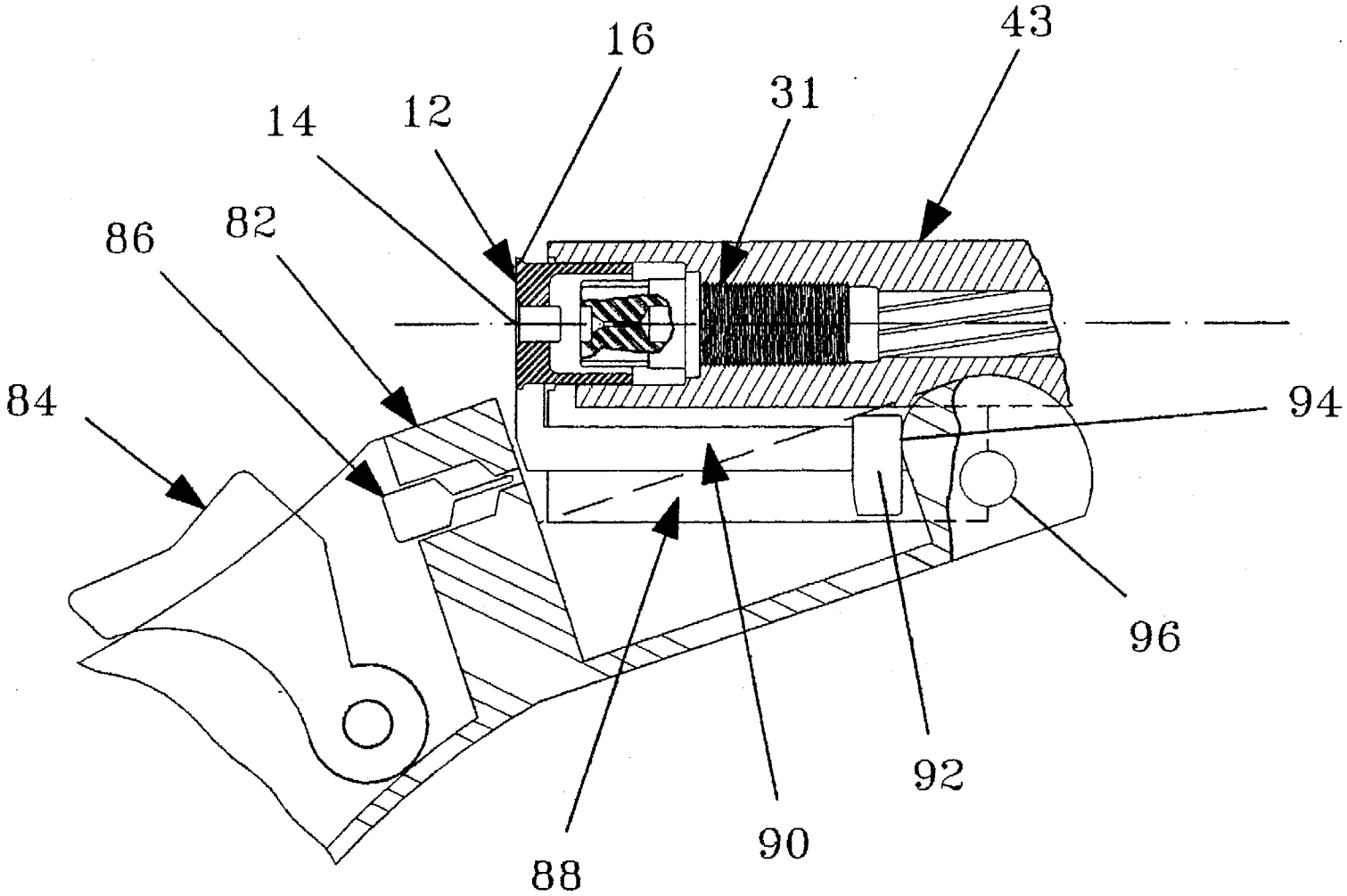

FIG. 13 is a section view of the aft end of a barrel and forward portion of a receiver (firearm is in the open position) showing one possible configuration of the extractor arrangement for use in applicant's muzzle-loading firearm design. Depicted are the ignition device carrier and ignition device in the extracted position following extraction mechanically by rotating the receiver downward from the breech end of the barrel.

DESCRIPTION OF PREFERRED EMBODIMENTS

Figure 1:
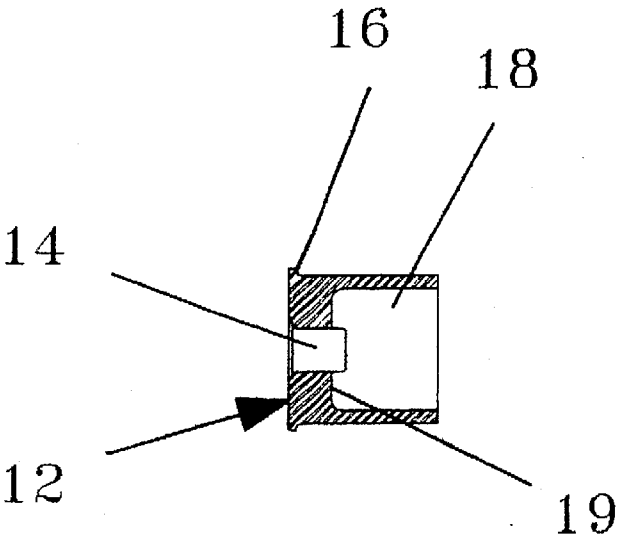
FIG. 1 is a section view of the ignition device carrier portion of applicant's nuzzle-loading firearm. Shown is a rimmed carrier configuration similar to a shotgun, rimmed rifle or pistol cartridge case or jacket.

A typical embodiment of the ignition device carrier is illustrated in cross section in FIG. 1. An ignition device carrier 12 may be manufactured of any of a variety of plastics or metals or a combination thereof and is normally intended to be reusable. A plastic ignition device carrier may be totally reinforced with glass or graphite fibers or a thin metallic casing or locally reinforced with a thin metallic casing in the area of the extractor flange or groove. A plastic ignition device carrier can also be locally reinforced by the addition of a metallic insert to strengthen the area surrounding the recess receiving the ignition device either in a direction coaxial with the recess or radial to the recess.

Ignition device carrier 12 is basically the shape of a cylindrical jacket housing with a centrally located opening recess in its aft end to receive a percussion excited ignition device 14, which may be a conventional percussion cap, a modern shotgun cartridge primer, a modern metallic cartridge primer (rifle or pistol), or any other suitable ignition source. Ignition device carrier 12 is provided with an extractor flange 16, which is a means for the carrier to be positively mechanically extracted from the weapon. In the FIG. 1 embodiment, the opening is of uniform dimension, the ignition device is a shotgun primer press fitted therein, the forward position being determined by a flange at the rear end of the primer. A clearance counterbore 18 is provided to allow the carrier to protrude over or surround the rearward or aft end of the breech plug. Clearance counterbore 18 also provides a sealing surface 19 to mate with a seal 28 shown in FIG. 3.

Figure 2:
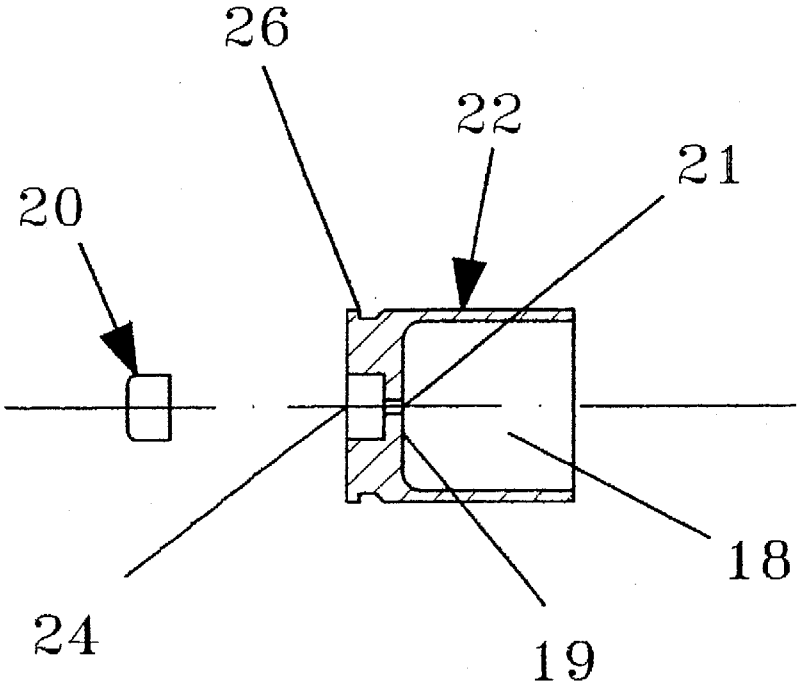
FIG. 2 is a section view of the ignition device carrier portion of applicant's muzzle-loading firearm. Shown is a rimless carrier configuration similar to a rimless rifle or pistol cartridge case or jacket.

A second embodiment of the ignition device carrier is illustrated in cross section in FIG. 2. This second of many possible embodiments utilizes a configuration similar to a rimless rifle or pistol cartridge and could be used with any of the various existing action types which now use the rimless cases. FIG. 2 shows pictorially a metallic cartridge primer 20 as the ignition device. This configuration could easily utilize a shotgun primer or traditional percussion cap with only minor alterations to the design. Metallic cartridge primer 20 is received in a primer recess 24, which positions metallic cartridge primer 20 so as to communicate flammable energy of the ignition flame through an axial carrier flash hole 21 that is smaller in size than the primer hole or recess with an axial flash hole 32 in a breech plug 31 shown in FIG. 3. Clearance counterbore 18 also provides sealing surface 19 to mate with seal 28 shown in FIG. 3. Rather than extractor flange 16 shown in FIG. 1, this embodiment discloses a circumferential extractor groove 26, so that the resulting flange is at the same radial dimension as the outside of the jacket of the carrier.

Figure 3:
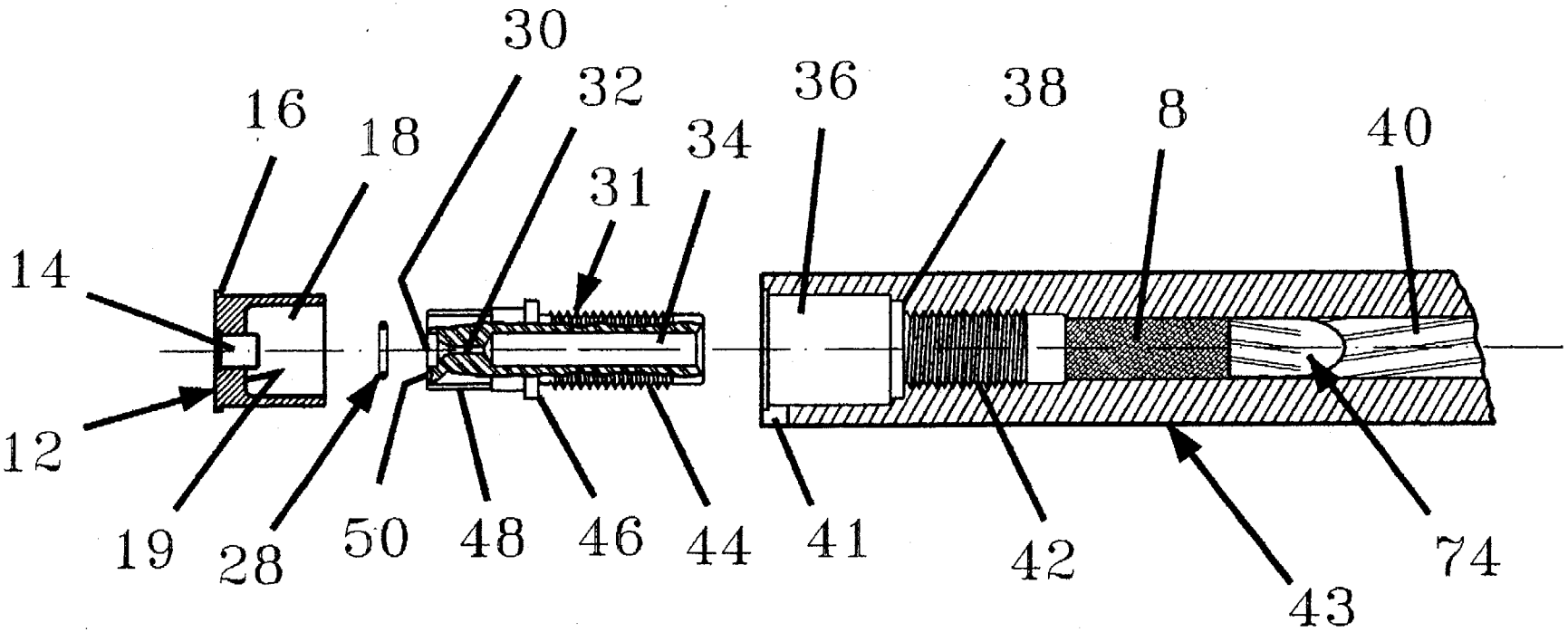
FIG. 3 is an assembly drawing showing one possible design for the gun breech utilizing the primer carrier portion of applicant's muzzle-loading firearm.
Figure 9:
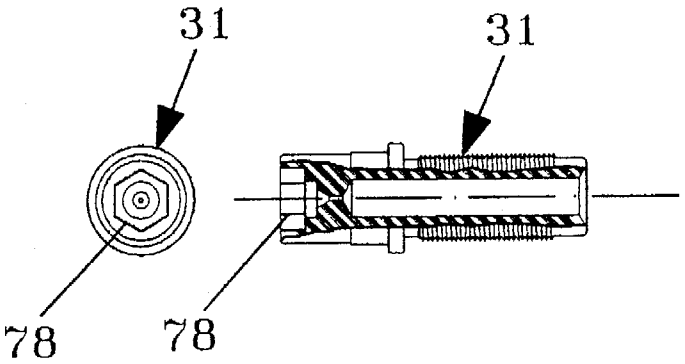
FIG. 9 is a section and end view showing one possible configuration of the breech plug of applicant's muzzle-loading firearm. Depicted is a polygon shaped recess in the aft end, for use in the installation and removal of the breech plug from the barrel.
Figure 8:
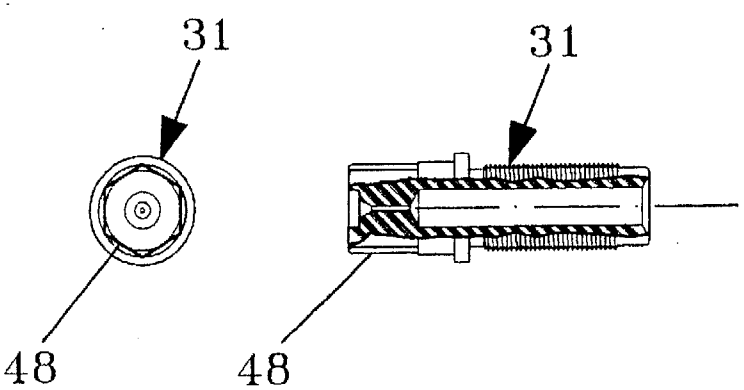
FIG. 8 is a section and end view showing one possible configuration of the breech plug of applicant's muzzle-loading firearm. Depicted is a polygon shaped aft end, for installation and removal of the breech plug from the barrel.
Figure 10:
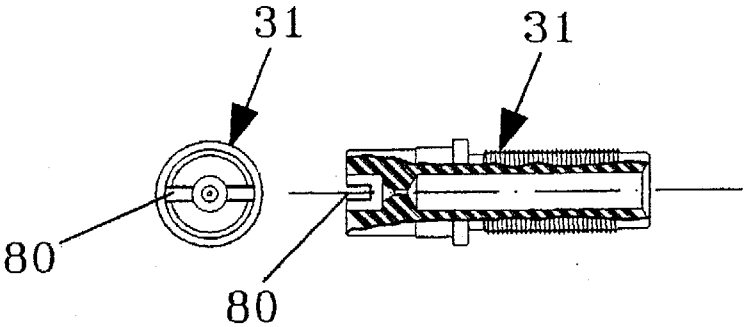
FIG. 10 is a section and end view showing one possible configuration of the breech plug of applicant's muzzle-loading firearm. Depicted is a transverse slot in the aft end, for installation and removal of the breech plug from the barrel.

FIG. 3 is an exploded assembly cross section drawing showing ignition device carrier 12 holding ignition device 14 positioned to protrude into a breech plug counterbore 30. Seal 28 is shown, which may be any of a variety of types such as soft metallic washers, plastic washers, metallic "O rings" or plastic or rubber like "O rings". The plastic or rubber like "O ring" type seal is preferred. Breech plug 31 seals the rearward end of a barrel 43 by means of breech plug threads 44 engaging breech plug receiving threads 42 formed into barrel 43. Breech plug 31 is provided with a radially enlarged breech plug/barrel sealing surface 46 to mate with a barrel/breech plug sealing end wall surface 38 of barrel 43. The aft end of breech plug 31 is provided with a breech plug hex 48 (the preferred means) as shown in FIG. 8, or a polygon shaped cavity 78 as shown in FIG. 9, or a transverse slot 80 as shown in FIG. 10 to facilitate removal from barrel 43. Barrel 43 is machined to receive breech plug threads 44 of breech plug 31 into breech plug receiving threads 42. The aft end of barrel 43 is also machined to provide an ignition device carrier counterbore 36 into which ignition device carrier 12 is positioned. Counterbore 36 is also provided with an extractor recess 41 allowing a mechanical extractor to grip extractor flange 16 of carrier 12.

FIG. 8 shows one possible breech plug 31 configuration, which utilizes breech plug hex 48 as a polygon shaped aft end as the torque transmitting means allowing installation and removal of breech plug 31 from the aft end of the barrel. This is but one of many possible configurations allowing for installation and removal of breech plug 31.

FIG. 9 shows another possible breech plug 31 configuration, which utilizes breech plug hex recess 78 as a polygon shaped recess in the aft end as the torque transmitting means allowing installation and removal of breech plug 31 from the aft end of the barrel. Thus, this is but one of many possible configurations allowing for installation and removal of breech plug 31.

FIG. 10 shows yet another possible breech plug 31 configuration, which utilizes breech plug transverse slot 80 as the torque transmitting means allowing installation and removal of breech plug 31 from the aft end of the barrel. Thus, this also is but one of many possible configurations allowing for installation and removal of breech plug 31.

Figure 11:
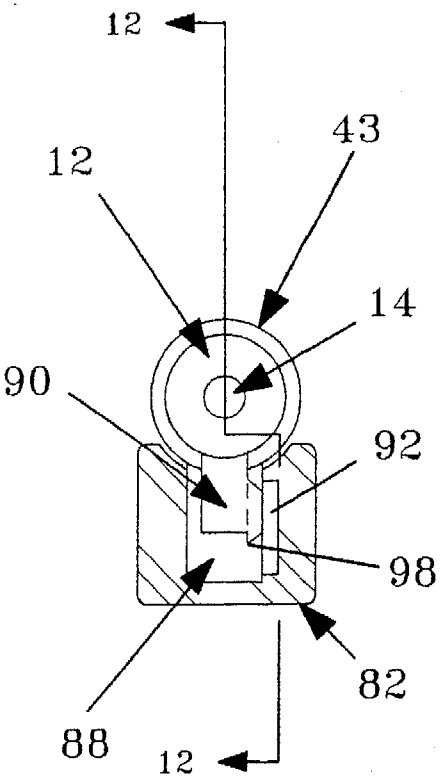
FIG. 11 is a view of the aft end of the barrel showing one possible configuration of the extractor arrangement for use in applicant's muzzle-loading firearm design. Depicted are the ignition device carrier, ignition device, extractor, extractor shoe, and a section of the receiver.

FIG. 11 is a view of the aft end of barrel 43 showing one possible configuration providing for mechanical extraction of ignition device carrier 12. Shown are ignition device 14 carried in ignition device carrier 12 positioned in aft end of barrel 43. Barrel 43 is shown in assembled position within receiver 82 with extractor 90 installed in extractor dovetail slot 98 cut into the side of barrel hinge block 88. Barrel hinge block 88 is attached securely to barrel so as to form one structural unit. This is but one of many possible configurations allowing for mechanical extraction of ignition device carrier 12.

Figure 12:
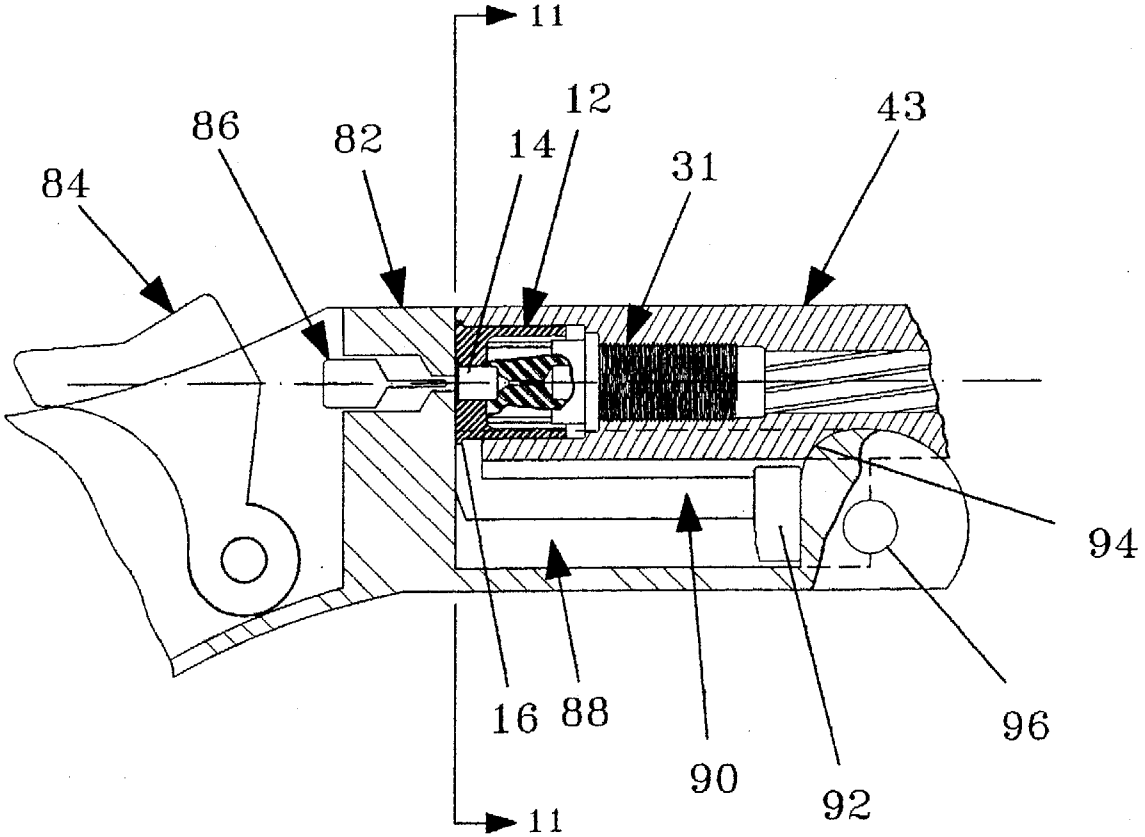
FIG. 12 is a section view of the aft end of a barrel and forward portion of a receiver (firearm is in the closed position) showing one possible configuration of the extractor arrangement for use in applicant's muzzle-loading firearm design. Depicted are the ignition device carrier, ignition device, breech plug, extractor, extractor shoe, firing pin, hammer, and a portion of the receiver.

FIG. 12, when viewed in conjunction with FIG. 13, reveals the function of the mechanical extraction feature of the invention. Depicted are ignition device carrier 12 holding ignition device 14 in firing position within the aft end of barrel 43. FIG. 12 shows barrel 43 and receiver 82 in firing position.

FIG. 13 shows receiver 82 rotated away from barrel 43, extractor 90, ignition device carrier 12, and ignition device 14 extended a short distance from the aft end of barrel 43 allowing for easy removal of ignition device carrier 12 and ignition device 14.

Figure 4:
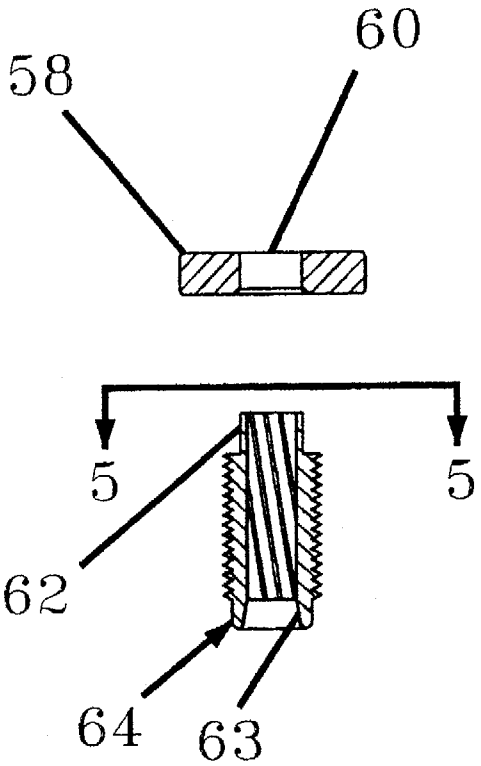
FIG. 4 is a section view showing the configuration of the bullet engraving die portion of applicant's muzzle-loading firearm.

A means of forming bullets to match the rifling of barrel 43 is disclosed in FIG. 4. A portion of the same rifled blank used to make barrel 43 is machined to form a die body 64, which may be externally threaded to allow mounting the die in a mechanical or hydraulic press. The barrel of the die includes the same number of rifling grooves at the same rifling angle as the barrel for which projectiles to be made are to be employed. The forward end of the die is reduced in outside diameter forming a sizing portion of die 62. Sizing portion of die 62 is slightly reduced in inside diameter by forcing a die sizing ring 58 over the end of sizing portion of die 62. A die sizing ring bore 60 is machined to be slightly (0.0005 to 0.0025 of an inch) smaller than sizing portion of die 62. The end of sizing portion of die 62 is cold forged to widen lands 56 at the discharge end of the die. The end of sizing portion of die 62 is struck by a radially oriented cold chisel or parting tool. The cold forging process is applied to each land of the die at land upset locations 52 indicated in FIG. 5. This produces a slightly (0.0005 to 0.0010 of an inch) wider land at the discharge end of the die thus the rifling engraved on bullets by this die has grooves wider than the lands of the barrel into which they will be loaded. Through this means, clearance is provided between the bullet and barrel in both diameter and circumference along the sides of the rifling lands.

Figure 6:
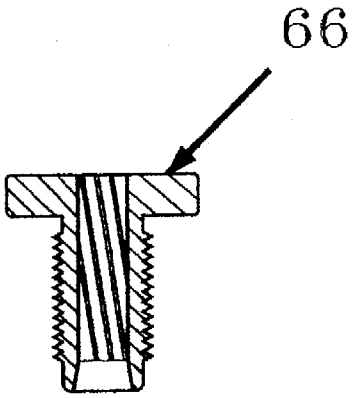
FIG. 6 is a section view of a one piece bullet engraving die specifically manufactured to produce a bullet of the desired dimensions.

FIG. 6 is a cross section drawing of a one piece die 66 made by rifling a separate barrel with a slightly smaller diameter bore and a slightly wider land, then machining one piece die 66 from this barrel. This die includes rifling in its barrel matching in number and spiral angle the rifling of the firearm barrel with which a projectile to be rifled-engraved therewith is to be employed. FIG. 6 therefore illustrates what would be the preferred means for mass production of weapons using this system to engrave the bullets. Using modern button rifling techniques and modern rifling button grinding machinery, it is possible to manufacture one rifling button for use in making barrels and a second button for making bullet engraving dies. The two rifling buttons would be manufactured to the required dimensions to provide the necessary clearance for the bullets to be easily loaded into the rifle.

Figure 7:
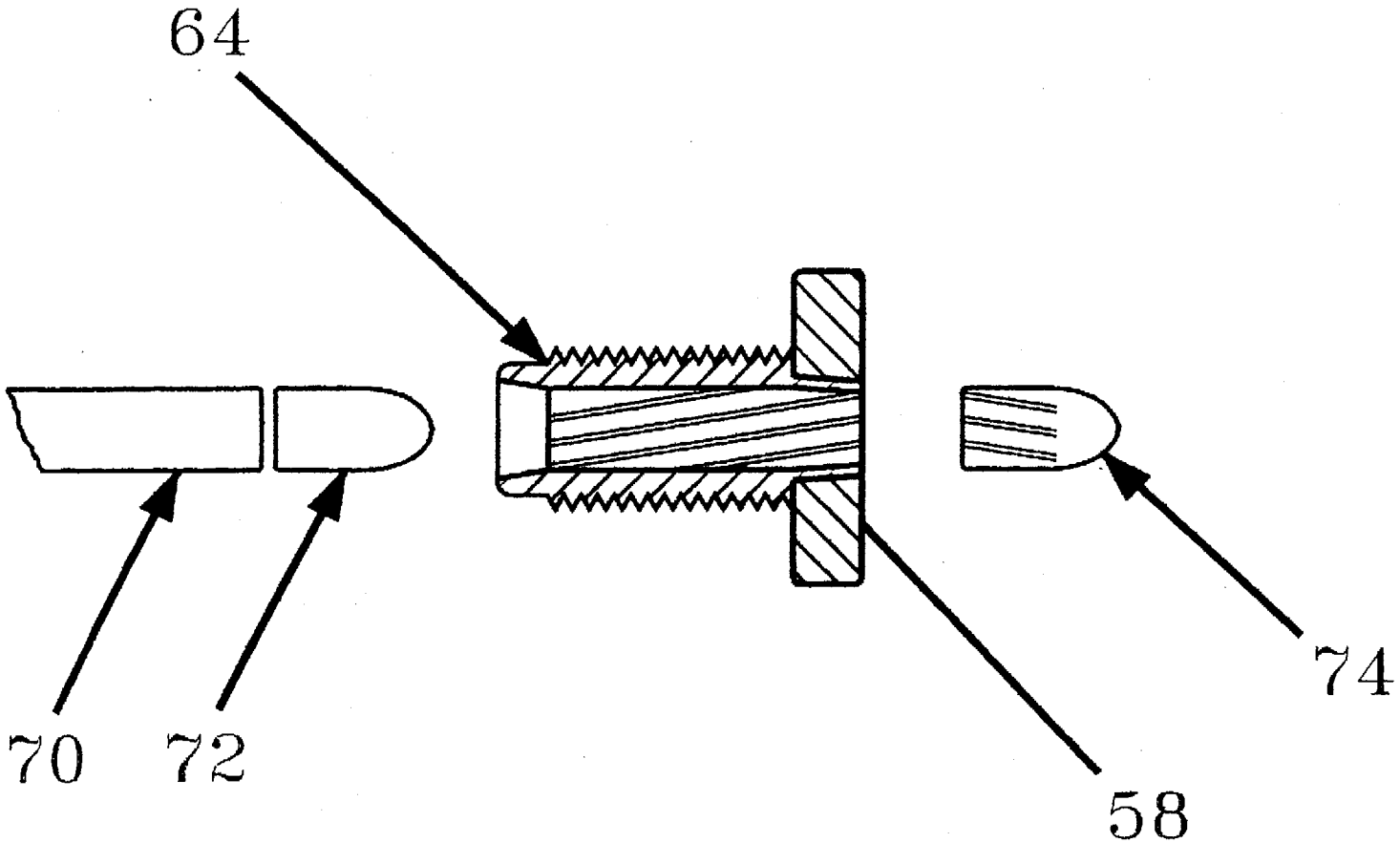
FIG. 7 is a section view of the bullet sizing die, which also shows the bullet before and after engraving. Also shown is the punch or arbor used to force the bullet through the engraving die.

An unengraved bullet 72 is force through die body 64 by an arbor 70 as shown in FIG. 7. The resulting engraved bullet 74 has a diameter slightly less than the rifle bore and the grooves in engraved bullet 74 are slightly wider than the lands of the rifle bore as explained above.

From the description above, a number of advantages of applicant's muzzle-loading firearm design are evident to a person skilled in the art of firearms design:

(a) Modern metal jacketed bullets may be used in a muzzle-loading firearm without the use of a sabot or patch.

(b) Lead bullets may be fired in a muzzle-loading rifle with a rifling twist rate tighter than the heretofore typical one turn in forty-eight inches. This is possible due to the methods disclosed here for engraving the bullet to a much greater depth than possible when forcing an unengraved bullet into the nuzzle-loader by hand. The deeper engraving provides a positive gripping action of the bullet on the rifling resulting in improved bullet spin rate and therefore improved accuracy.

(c) Bullets may be loaded into the muzzle-loading firearm with greatly reduced effort, as the rifling is pre-engrayed on the bullet.

(d) The typical percussion cap nipple is a small, fragile part and has been eliminated, thus simplifying manufacture and maintenance of the nuzzle-loading firearm.

(e) The muzzle-loading firearm design disclosed herein provides an easily removable breech plug (e.g., removable with a driving tool such as a standard socket wrench, "Allen" wrench, or large screw driver), thus allowing cleaning of the firearm with the muzzle or forward end of the barrel in the hot water cleaning solution and the ramrod or cleaning rod entering the breech end of the barrel. This cleaning technique, therefore, allows the use of short-eye-relief telescopic sights as they will not be subjected to submergence in the cleaning medium.

(f) The ignition device, be it percussion cap or modern primer, is well protected from the elements yet is easily installed and removed when used in conjunction with a bolt action, top break, or other appropriate firearm action.

(g) The ignition device carrier is provided with a rim or groove to accommodate a means of mechanical extraction, thus providing a more easily removed ignition device.

(h) The ignition device carrier provides a firearm with improved safety potential due to the ease of installation and removal of the carrier.

(i) Utilization of the ignition device carrier allows the use of many standard modern rifle, shotgun, or pistol actions, thus allowing the use of a variety of mechanical safety systems adapted to those designs.

(j) The use of the ignition device carrier with any of the standard modern firearm actions provides protective isolation of the shooter from the exploding gases produced by the primer ignition and subsequent powder detonation.

OPERATION—FIGS. 1, 3, 4, 5, 7, 11, 12, and 13

FIG. 3 pictorially illustrates the manner in which the ignition device carrier is used. The firearm barrel 43 is machined to receive threaded breech plug 31 and ignition device carrier 12. Breech plug 31 seals the aft or rear of the barrel. Ignition device carrier 12 is positioned in ignition device carrier counterbore 36 of barrel 43. In this position, the ignition device carrier places ignition device 14 protruding into and aligned with breech plug counterbore 30 in the aft end of breech plug 31. Breech plug 31 is provided with an axial flash hole 32 and an enlarged axial flash hole 34, which are the path through which ignition device 14 transmits an ignition flame to the powder charge located in the breech end of firearm bore 40. Seal 28 is placed in a seal groove 50 of breech plug 31. in this position, seal 28 is compressed between breech plug 31 and sealing surface 19 of ignition device carrier 12, thus sealing the ignition and combustion gases within the firearm bore and the breech plug.

Figure 5:
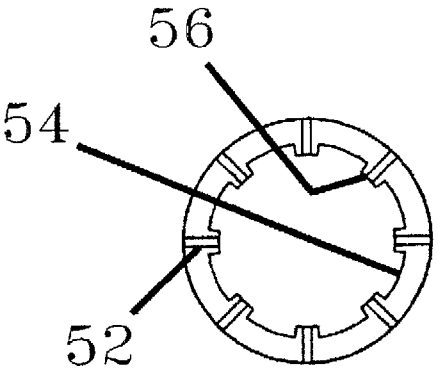
FIG. 5 is an end view of the engraving die showing details of one of the bore size altering methods disclosed in applicant's muzzle-loading firearm.

FIG. 7 illustrates the actual production of engraved bullet 74 by forcing unengraved bullet 72 through die body 64 using mechanical press arbor 70. FIG. 4 depicts die body 64 having an entry chamfer 63 to support easy entry of unengraved bullet 72 into die body 64 as shown in FIG. 7. Die body 64 shown in FIG. 4 includes sizing portion of die 62, the discharge end of which is shown in FIG. 5. Illustrated in FIG. 5 are lands 56 and grooves 54 of the rifling on the interior of die body 64. Land upset locations 52 indicated in FIG. 5 show the locations of the cold forging required to widen lands 56 (in a circumferential direction) by 0.0005 to 0.001 of an inch to prevent the engraved bullet from binding on the sides of the rifling lands when loaded into the barrel. Die sizing ring 58 shown in FIG. 4 is machined to have die sizing ring bore 60 0.0005 to 0.0025 of an inch smaller than sizing portion of die 62. Forcing of die sizing ring 58 over sizing portion of die 62 produces a reduced diameter at the outlet end of die body 64. Forcing an unengraved bullet through this engraving die produces an engraved bullet with the required clearance to be easily loaded by hand into the muzzle of a muzzle-loading rifle or pistol. Thus, the requirement of engraving the rifling while forcing the bullet into the firearm is eliminated.

FIG. 11 illustrates a view of the aft end of barrel 43 showing one possible configuration providing for mechanical extraction of ignition device carrier 12. Shown are ignition device 14 carried in ignition device carrier 12 positioned in aft end of barrel 43. Barrel 43 is shown in its assembled position within receiver 82, with extractor 90 installed in extractor dovetail slot 98 cut into the side of barrel hinge block 88. Barrel hinge block 88 is attached securely to the barrel so as to form one structural unit. FIG. 11, when viewed in association with FIG. 12, reveals the function of the mechanical extraction feature of the invention. FIG. 12 depicts ignition device carrier 12 holding ignition device 14 in firing position within the aft end of barrel 43. Barrel hinge block 88 is securely attached to barrel 43 and mates with receiver/barrel hinge pin 96, allowing receiver 82 to be rotated away from the aft end of barrel 43. Barrel hinge block 88 is provided with longitudinal dovetail slot 98 in which extractor 90 slides. Rotation of receiver 82 away from barrel 43 (often referred to as "opening the action") swings receiver 82 clear of the aft end of barrel 43 and simultaneously forces extractor 90 to slide aft, thus forcing ignition device carrier 12 out of the aft end of barrel 43. The described sliding action is effected by the action of receiver cam surface 94 upon extractor shoe 92. Extractor shoe 92 is an integral part of extractor 90 arranged to engage receiver can surface 94. As receiver 82 is rotated about receiver/barrel hinge pin 96 with barrel 43 held fixed, the radius from the center of receiver/barrel hinge pin 96 to the point of contact between extractor shoe 92 and receiver cam surface 94 increases, and extractor 90 is forced to slide away from receiver/barrel hinge pin 96. As extractor 90 is forced away from receiver/barrel hinge pin 96, the aft end of extractor 90 engages extractor flange 16 on ignition device carrier 12, thus forcing ignition device carrier 12 to slide out of the aft end of barrel 43 a short distance and allowing for easy removal of ignition device carrier 12, and thus ignition device 14, which is carried by ignition device carrier 12.

FIG. 13 shows the firearm in the open configuration described. Ignition device carrier 12 is shown in the extracted position, thus allowing convenient removal of ignition device carrier 12 and carried ignition device 14. installation of ignition device carrier 12 in proper firing position within the firearm is accomplished by rotating receiver 82 away from barrel 43 as previously described, inserting ignition device carrier 12 containing ignition device 14 in the aft end of barrel 43 and rotating receiver 82 into the closed position as shown in FIG. 12. Closing the action forces ignition device carrier 12, ignition device 14, and extractor 90 forward into proper firing position. FIGS. 11, 12, and 13 illustrate only one method of implementation of mechanical extraction of the ignition device carrier and the associated ignition device. Any of the extraction or ejection designs in use with regard to pistols, revolvers, shotguns, or rifles may be adapted to extract or eject the ignition device carrier from a muzzle-loading firearm, the means illustrated being only one method of the many mechanism capable of performing the same function.

SUMMARY, RAMIFICATION, AND SCOPE

Accordingly, the reader will see that applicant's muzzle-loading firearm disclosed herein, when utilized in conjunction with a top-break shotgun-type action (the preferred embodiment), provides a marked improvement in the design of ignition systems for nuzzle-loading firearms be they rifles, pistols, or shotguns. The bullet engraving die disclosed herein provides a novel means of manufacturing bullets which are matched to the bore of a rifle and can be used in firearms utilizing much faster rifling twist rates than the heretofore standard of one turn in forty-eight inches. Furthermore, the ignition device carrier and pre-engraved bullet concepts disclosed herein offer additional advantages. They allow:

- modern metal-jacketed bullets to be used in a muzzle-loading firearm without the use of a sabot or patch;
- lead bullets with deeply engraved rifling to be fired in a muzzle-loading rifle having much faster twist rates than the heretofore typical one turn in forty-eight inches;
- bullets to be loaded into muzzle-loading rifles with greatly reduced effort, as the rifling is pre-engraved on the bullet;
- the typical percussion cap nipple, which is a small, fragile part, to be eliminated, thus simplifying manufacture and maintenance of the muzzle-loading firearm;
- a standard short-eye-relief telescopic sight to be used on an easily cleaned muzzle-loading firearm;
- greatly improved protection of the ignition device from the elements;
- positive mechanical extraction of the ignition device through use of the rim or extractor groove provided on the ignition device carrier;
- the adaptation of many modern firearm actions for use in conjunction with a muzzle-loading firearm;
- the incorporation of proven safety mechanisms used on many modern firearm actions into muzzle-loading firearm design; and
- protective isolation of the shooter from the exploding gases produced by the primer ignition and subsequent powder detonation within the firearm.

Although the description above contains many specifics, these should not be construed as limiting the scope of the invention but merely providing illustrations of some of the features of the preferred embodiments. For example, the carrier could have no flange or groove to provide extractor gripping, rather the extractor could engage the forward end of the ignition device carrier. Although illustrated as used with a rifled firearm, the ignition device carrier could also be used with smooth bore muskets, pistols, or shotguns. An additional embodiment of the ignition device carrier could be to manufacture the ignition device having a case appropriately configured and large enough to serve the same function as, and preclude the use of, the carrier disclosed herein.

A further ramification concerning the bullet engraving die, when used in conjunction with a polygon shaped bore rather than the conventional rifling illustrated, would allow the elimination of cold forging required to widen the lands. The bore of the die could be brought to the required dimensions by installation of the die sizing ring alone.

Therefore, the scope of the invention should be determined by the appended claims and their obvious and legal equivalents, rather than by the preferred embodiment illustrated and the examples of additional embodiments given.

What is claimed is:

1. The combination of a rifled barrel of a muzzle-loading firearm and a muzzle-loading firearm bullet-shaped cylindrical projectile for being fired therefrom, said projectile having uniformly deep rifling grooves pre-formed over its cylindrical surface that matches in number and spiral angle the rifling of the firearm barrel, said rifling grooves of said projectile being wider than the lands of the rifling of the firearm barrel and being of smaller outside diameter than the inside diameter of the firearm barrel so as to provide clearance over the entire barrel length between said projectile and the barrel in both diameter and circumference along the sides of the rifling lands of the firearm barrel and the rifling grooves of said projectile, thereby imparting a stabilizing spin to said projectile when fired from the barrel.

2. A projectile in accordance with claim 1, wherein the rifling twist rate of said rifling grooves is tighter than one turn in 48 inches of longitudinal distance of the barrel.

3. A projectile in accordance with claim 1, wherein said rifling grooves of said projectile are wider than the lands of the firearm barrel rifling within the range of 0.0005 to 0.001 inch.

* * * * *

UNITED STATES PATENT AND TRADEMARK OFFICE

CERTIFICATE OF CORRECTION

PATENT NO. : 5,737,863

DATED : April 14, 1998

INVENTOR(S) : William F. Rainey, III

It is certified that error appears in the above-indentified patent and that said Letters Patent is hereby corrected as shown below:

Col. 2, line 42, change "1993" to --1973--

Col. 7, line 38, change "force" to --forced--

Col. 7, line 55, change "nuzzle" to --muzzle--

Col. 7, lines 61 and 62, change "pre-engrayed" to --pre-engraved--

Col. 7, line 65, change "nuzzle" to --muzzle--

Col. 8, line 47, change "in" to --In--

Col. 9, line 32, change "can" to --cam--

Col. 9, line 48, change "installation" to --Installation--

Col. 10, line 3, change "nuzzle" to --muzzle--

Signed and Sealed this

Twenty-first Day of July, 1998

Bruce Lehman

*Attest:*

BRUCE LEHMAN

*Attesting Officer*

*Commissioner of Patents and Trademarks*